US009905129B2

(12) United States Patent
Colella et al.

(10) Patent No.: US 9,905,129 B2
(45) Date of Patent: Feb. 27, 2018

(54) EMERGENCY CORRIDOR UTILIZING VEHICLE-TO-VEHICLE COMMUNICATION

(71) Applicant: Ford Global Technologies, LLC, Dearborn, MI (US)

(72) Inventors: Nicholas Colella, Grosse Ile, MI (US); Dave A Herman, Southfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/170,482

(22) Filed: Jun. 1, 2016

(65) Prior Publication Data

US 2017/0352268 A1 Dec. 7, 2017

(51) Int. Cl.

| | |
|---|---|
| ***G08G 1/00*** | (2006.01) |
| ***G08G 1/0967*** | (2006.01) |
| ***G08G 1/09*** | (2006.01) |

(52) U.S. Cl.

CPC ..... *G08G 1/096791* (2013.01); *G08G 1/091* (2013.01)

(58) Field of Classification Search

CPC ..... G01G 1/096791; G08G 1/0965; G08G 1/096741

USPC ..... 340/902, 901, 905, 938, 995; 701/431

See application file for complete search history.

(56) References Cited

U.S. PATENT DOCUMENTS

| | | | | |
|---|---|---|---|---|
| 5,825,304 | A | 10/1998 | Marin | |
| 6,614,362 | B2 | 9/2003 | Siegel | |
| 6,700,504 | B1 * | 3/2004 | Aslandogan | G08G 1/087 340/901 |
| 7,271,736 | B2 | 9/2007 | Siegel et al. | |
| 8,350,721 | B2 * | 1/2013 | Carr | G08G 1/0965 340/902 |
| 8,599,039 | B2 | 12/2013 | Otero et al. | |
| 9,224,294 | B1 * | 12/2015 | St. John | G08G 1/0965 |
| 9,333,913 | B1 * | 5/2016 | Elders | B60Q 9/008 |

OTHER PUBLICATIONS

Laura Bieker, *Emergency Vehicle Prioritization Using Vehicle-to-Infrastructure Communication*, Institute of Transportation Systems, Jun., 2011 (20 pages).

(Continued)

*Primary Examiner* — Toan N Pham

(74) *Attorney, Agent, or Firm* — James P. Muraff; Neal, Gerber & Eisenberg LLP

(57) ABSTRACT

Systems and methods are disclosed for an emergency corridor utilizing vehicle-to-vehicle communication. An example disclosed system includes an emergency vehicle, infrastructure nodes distributed across a municipal area, and an emergency router. The example emergency router selects a route from a first location of the emergency vehicle to a second location specified by an emergency request. The example emergency router also determines ones of the infrastructure nodes that are along the route. Additionally, the example emergency router instructs the ones of the infrastructure nodes to broadcast emergency messages. The emergency messages include information regarding the route and the emergency vehicle.

14 Claims, 7 Drawing Sheets

(56) References Cited

OTHER PUBLICATIONS

DENSO to Begin Vehicle-to-Vehicle and Vehicle-to-Infrastructure Technology Field Tests in China, DENSO Global Website, [online] retrieved Mar. 21, 2016 from http://www.globaldenso.com/en/newsreleases/120313-01.html (3 Pages).
Lockheed Martin, Core System Requirements Specification (SyRS), U.S. Department of Transportation, Research and Innovative Technology Administration, Apr. 2011 (131 Pages).

* cited by examiner

EMERGENCY CORRIDOR UTILIZING VEHICLE-TO-VEHICLE COMMUNICATION

TECHNICAL FIELD

The present disclosure generally relates to vehicles with vehicle-to-vehicle communication and, more specifically, an emergency corridor utilizing vehicle-to-vehicle communication.

BACKGROUND

Emergency response vehicles often have difficulty navigating through traffic, especially in large metropolitan areas. As the emergency response vehicle approaches a pack of other vehicles, the drivers of those vehicles must hear or see the oncoming first responder and then determine what they should do to enable the first responder to pass. Quite often, drivers will not notice the first responder which slows the response and/or causes other traffic issues.

SUMMARY

The appended claims define this application. The present disclosure summarizes aspects of the embodiments and should not be used to limit the claims. Other implementations are contemplated in accordance with the techniques described herein, as will be apparent to one having ordinary skill in the art upon examination of the following drawings and detailed description, and these implementations are intended to be within the scope of this application.

Example embodiments are disclosed for an emergency corridor utilizing vehicle-to-vehicle communication. An example disclosed system includes an emergency vehicle, infrastructure nodes distributed across a municipal area, and an emergency router. The example emergency router selects a route from a first location of the emergency vehicle to a second location specified by an emergency request. The example emergency router also determines ones of the infrastructure nodes that are along the route. Additionally, the example emergency router instructs the ones of the infrastructure nodes to broadcast emergency messages. The emergency messages include information regarding the route and the emergency vehicle.

An example disclosed method to create an emergency corridor for an emergency vehicle includes determining a route for the emergency vehicle. The example method also includes determining infrastructure nodes along the route. Additionally, the method includes broadcasting emergency messages from the infrastructure nodes along the route. The emergency messages include the route, current location, heading, and speed of the emergency vehicle.

An example method includes receiving an emergency message that includes a route, a current location, a current heading, and a current speed of an emergency vehicle. The example method also includes determining whether a trajectory of the vehicle will be parallel or intersect the route. Additionally, the example method includes, in response to determining that the trajectory of the vehicle will be parallel or intersect the route, providing an audio and visual warning based on instructions included in the emergency message.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1:
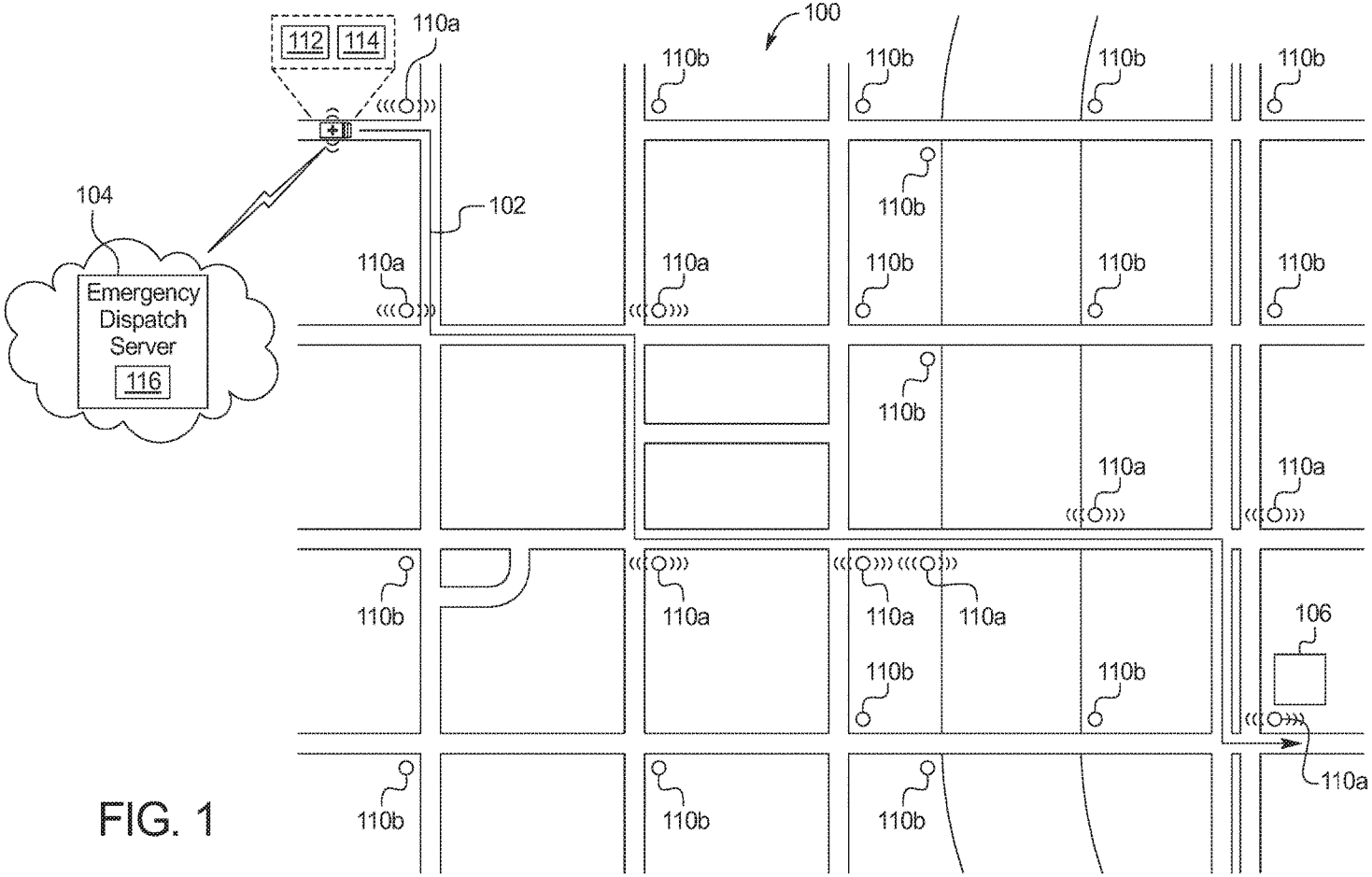
FIG. 1 is a system diagram depicting a map with an emergency corridor in accordance with the teachings of this disclosure.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

Emergency responder vehicles (e.g., ambulances, fire engines, police vehicles, crash response units, etc.) often navigate through traffic when responding to emergency situations. The traffic can slow the emergency responder vehicle. As disclosed below, an emergency corridor is created using dedicated short range communication (DSRC) nodes installed on infrastructure (e.g., traffic lights, traffic control boxes, buildings, lamp posts, bridges, tunnels, etc.). When an emergency is declared either by the emergency responder vehicle or an emergency dispatch center, the emergency router of the emergency dispatch center selects a corridor route from the current location of the emergency responder vehicle to the location of the emergency. The corridor route is based on for example, weather data, traffic data, navigation data, and locations of nodes installed on the infrastructure (sometime referred to as "infrastructure nodes"). After the corridor route is selected, the emergency router instructs the infrastructure nodes along the corridor route to broadcast an emergency corridor message. The emergency corridor message includes information to inform other vehicles of the emergency corridor and instructions regarding how to behave. For example, the emergency corridor message may include the location of the emergency responder vehicle, the velocity of the emergency responder vehicle, the route of the emergency corridor, and a requested lane to move out of. In some examples, the emergency responder vehicle will broadcast the emergency corridor message.

The vehicles that receive the emergency corridor message determine if their route will run parallel or intersect the emergency corridor. If so, the vehicle will present an audio and/or visual notification to the occupants of the vehicle and provide instructions (e.g., "pull over to the right"). In some examples, the vehicles that receiver the emergency corridor message rebroadcast the emergency corridor message. In such a manner, the emergency corridor message may be propagated in areas where the infrastructure nodes are sparse or in locations where the DSRC signals do not travel far (e.g., locations with tall buildings, etc.).

FIG. 1 is a system diagram depicting a map 100 with an emergency corridor 102 in accordance with the teachings of this disclosure. From time-to-time, an emergency dispatch server 104 receives an emergency call that requests emergency responders (e.g. paramedics, police officers, firefighters, etc.) come to a location 106. An emergency vehicle 108 receives instructions from the emergency dispatch server 104 to travel to the location 106 along the emergency corridor 102.

Infrastructure nodes 110*a* and 110*b* are installed on infrastructure around a municipal area. For example, the infrastructure nodes 110*a* and 110*b* may be installed on traffic signals, traffic control boxes, bridges, tunnel entrances, lamp posts, etc. The infrastructure nodes 110*a* and 110*b* are communicatively coupled to the emergency dispatch server 104. When instructed by the emergency dispatch server 104, the infrastructure nodes 110*a* along the emergency corridor 102 broadcast an emergency corridor message via dedicated short range communication (DSRC). In some examples, the infrastructure nodes 110*a* and 110*b* track the location of the emergency vehicle 108 based on the emergency corridor messages. In such examples, the infrastructure nodes 110*a* along the route of the emergency corridor 102 stop broadcasting the emergency corridor messages when the emergency vehicle 108 has passed the respective infrastructure node 110*a*.

The example infrastructure nodes 110*a* and 110*b* include antenna(s), radio(s) and software to broadcast the emergency corridor messages. DSRC is a wireless communication protocol or system, mainly meant for transportation, operating in a 5.9 GHz spectrum band. More information on the DSRC network and how the network may communicate with vehicle hardware and software is available in the U.S. Department of Transportation's Core June 2011 System Requirements Specification (SyRS) report (available at http://www.its.dot.gov/meetings/pdf/CoreSystem_SE_SyRS_RevA%20(2011-06-13).pdf), which is hereby incorporated by reference in its entirety along with all of the documents referenced on pages 11 to 14 of the SyRS report. DSRC systems may be installed on vehicles and along roadsides on infrastructure. DSRC systems incorporating infrastructure information is known as a "roadside" system. DSRC may be combined with other technologies, such as Global Position System (GPS), Visual Light Communications (VLC), Cellular Communications, and short range radar, facilitating the vehicles communicating their position, speed, heading, relative position to other objects and to exchange information with other vehicles or external computer systems. DSRC systems can be integrated with other systems such as mobile phones.

Currently, the DSRC network is identified under the DSRC abbreviation or name. However, other names are sometimes used, usually related to a Connected Vehicle program or the like. Most of these systems are either pure DSRC or a variation of the IEEE 802.11 wireless standard. The term DSRC will be used throughout herein. However, besides the pure DSRC system it is also meant to cover dedicated wireless communication systems between cars and roadside infrastructure system, which are integrated with GPS and are based on an IEEE 802.11 protocol for wireless local area networks (such as, 802.11p, etc.).

The emergency vehicle 108 (e.g., an ambulance, a fire truck, a police car, etc.) includes audio and visual indicators to use when it has been dispatched to the location 106. The emergency vehicle 108 is in communication with the emergency dispatch server 104 via, for example, the ultra-high frequency (UHF) radio band (406 MHz to 470 MHz). In some examples, the emergency vehicle 108 is also equipped with a DSRC module 112 to broadcast the corridor messages and, as a secondary communication channel, communicate with the emergency dispatch server 104 via the infrastructure nodes 110*a* and 110*b*. For example, the emergency vehicle 108 may use the UHF radio band for voice communication and DSRC for data communication. Additionally, the emergency vehicle 108 includes a global positioning system (GPS) receiver 114 to provide the coordinates of the emergency vehicle 108 to the emergency dispatch server 104.

The emergency dispatch server 104 includes an emergency router 116 to generate the emergency corridor 102 based on the current location of the emergency vehicle 108 and the location 106 of the emergency. As disclosed in connection with FIG. 2 below, the emergency router 116 selects a route for the emergency corridor 102. The selected route is based on, for example, weather data, traffic data, the locations of infrastructure nodes 110*a* and 110*b*, and/or other advisories (e.g., road closures, other emergency corridors, etc.), etc. The emergency router 116 provides the selected route to a navigation system on the emergency vehicle 108. Additionally, the emergency router 116 determines which ones of the infrastructure nodes 110*a* and 110*b* are along the selected route of the emergency corridor 102. The emergency router 116 instructs the infrastructure nodes 110*a* are along the selected route to broad cast the emergency corridor message, which includes the current location of the emergency vehicle 108, the velocity of the emergency vehicle 108, the route of the emergency corridor 102, and a requested lane to move out of. From time to time, the emergency router 116 updates the emergency corridor message to reflect the current location of the emergency vehicle 108, the current velocity of the emergency vehicle 108, and/or any changes to the route of the emergency corridor 102.

Figure 2:
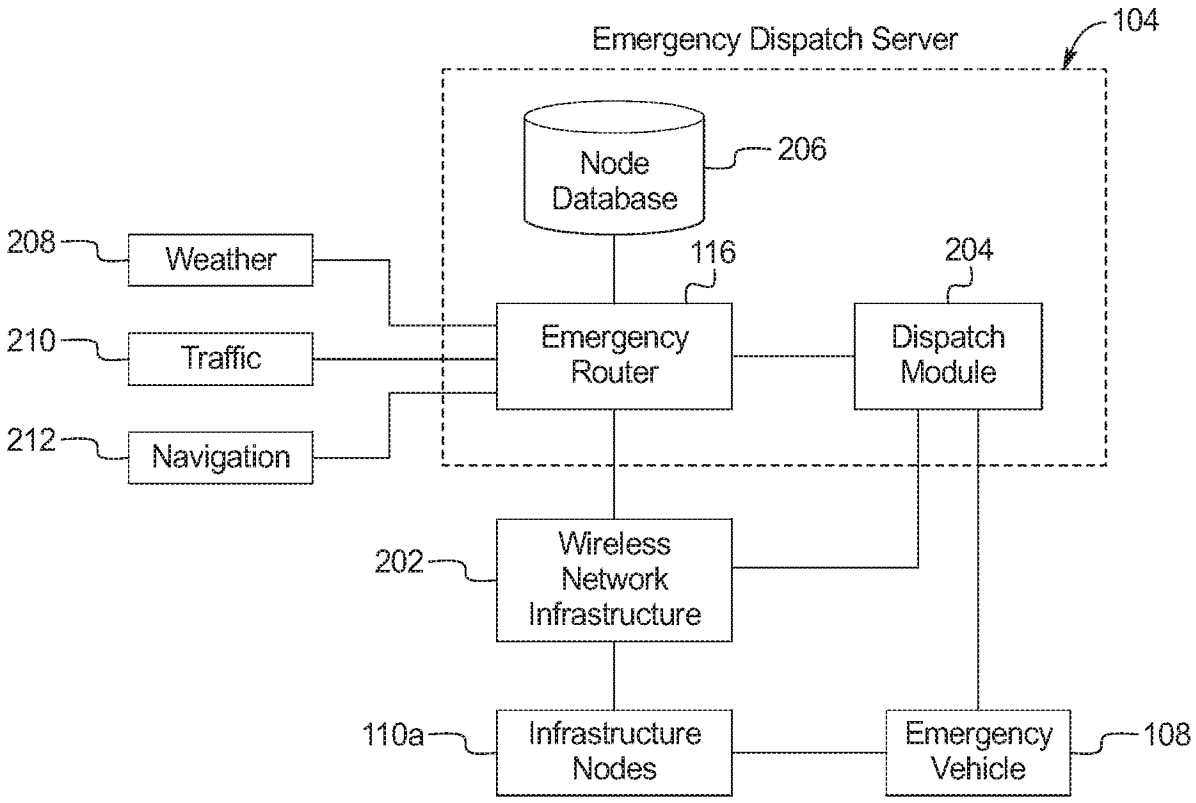
FIG. 2 is a block diagram of the emergency dispatch server of FIG. 1.

FIG. 2 is a block diagram of the emergency dispatch server 104 of FIG. 1. In the illustrated example, the emergency dispatch server 104 is communicatively coupled to the infrastructure nodes 110*a* and 110*b* via wireless network infrastructure 202. The wireless network infrastructure 202 (*a*) manages the connection between the emergency dispatch server 104 and the infrastructure nodes 110*a* and 110*b* and (b) routes instructions and information between the emergency dispatch server 104 and the infrastructure nodes 110*a* and 110*b*. The wireless network infrastructure 202 may include one or more of a wide area network (e.g., such as a cellular network (e.g., Global System for Mobile Communications ("GSM"), Universal Mobile Telecommunications System ("UMTS"), Long Term Evolution ("LTE"), Code Division Multiple Access ("CDMA"), etc.), a satellite communication network, WiMAX ("IEEE 802.16m), etc.) and/or local area network(s) (e.g., IEEE 802.11 a/b/g/n/ac, etc.).

The emergency dispatch server 104 includes a dispatch module 204, a node database 206 and the emergency router 116. The dispatch module 204 is communicatively coupled with the emergency vehicle 108 via the infrastructure nodes 110*a* and 110*b* and/or radio frequency communication (e.g., the UHF radio band). The dispatch module 204 receives the location 106 of a requester of emergency services. In some examples, the dispatch module 204 receives the location 106 of the requester of emergency services from emergency monitoring services, such as fire alarm system, security systems, medical monitoring systems, etc. In some examples, the dispatch module 204 receives the location 106 of the requester of emergency services from a dispatcher. Additionally, the dispatch module 204 tracks the locations of the emergency vehicles 108. In some examples, the dispatch module 204 provides information for one of the emergency vehicles 108 to the emergency router 116. For example, the dispatch module 204 may provide the information for the emergency vehicles 108 that is closest to the location 106. Alternatively, the dispatch module 204 provides information for the emergency vehicles 108 within a radius of the location 106.

The node database 206 stores the coordinates of the infrastructure nodes 110*a* and 110*b*. In some examples, the node database 206 includes information regarding properties of the infrastructure nodes 110*a* and 110*b*, such as directionality, maintenance history, approximate range, nearby intersections, etc. The node database 206 may be implemented using any suitable memory and/or data storage apparatus and techniques.

The emergency router 116 is commutatively coupled to the infrastructure nodes 110*a* and 110*b* via the wireless network infrastructure 202. The emergency router 116 is communicatively connected to a weather server 208 that provides weather data, a traffic server 210 that provides traffic data, and a navigation server 212 that provides map and navigation data (e.g., road composition, road grade, curves, etc.). In some examples, the servers 208, 210, and 212 provide application program interfaces (APIs) to facilitate the emergency router 116 obtaining the corresponding data.

The emergency router 116 receives the location 106 of the requester of emergency services and the location(s) of the emergency vehicle(s) 108 from the dispatch module 204. The emergency router 116 determines potential routes between the location 106 of the requester of emergency services and the location(s) of the emergency vehicle(s) 108. The potential routes are divided into segments. For example, the segments may represent a portion of road between two intersections. The emergency router 116 analyzes the segments based on the weather data, the traffic data, and/or the navigation data to select a contiguous set of segments from the location of one of the emergency vehicles 108 to the location 106 of the requester of emergency services to the route of the emergency corridor 102.

Based on the route of the emergency corridor 102, the emergency router 116 receives identifiers (e.g., network addresses, etc.) of the infrastructure nodes 110*a* along the route from the node database 206. The emergency router 116 generates an emergency message and instructs the identified infrastructure nodes 110*a* to broadcast the emergency message. The emergency router 116 sends the route of the emergency corridor 102 to the navigation system of the emergency vehicle 108. In some examples, the emergency router 116 sends the emergency message to the emergency vehicle 108 for the emergency vehicle 108 to broadcast while traveling to the location 106 of the requester of emergency services.

Figure 3:
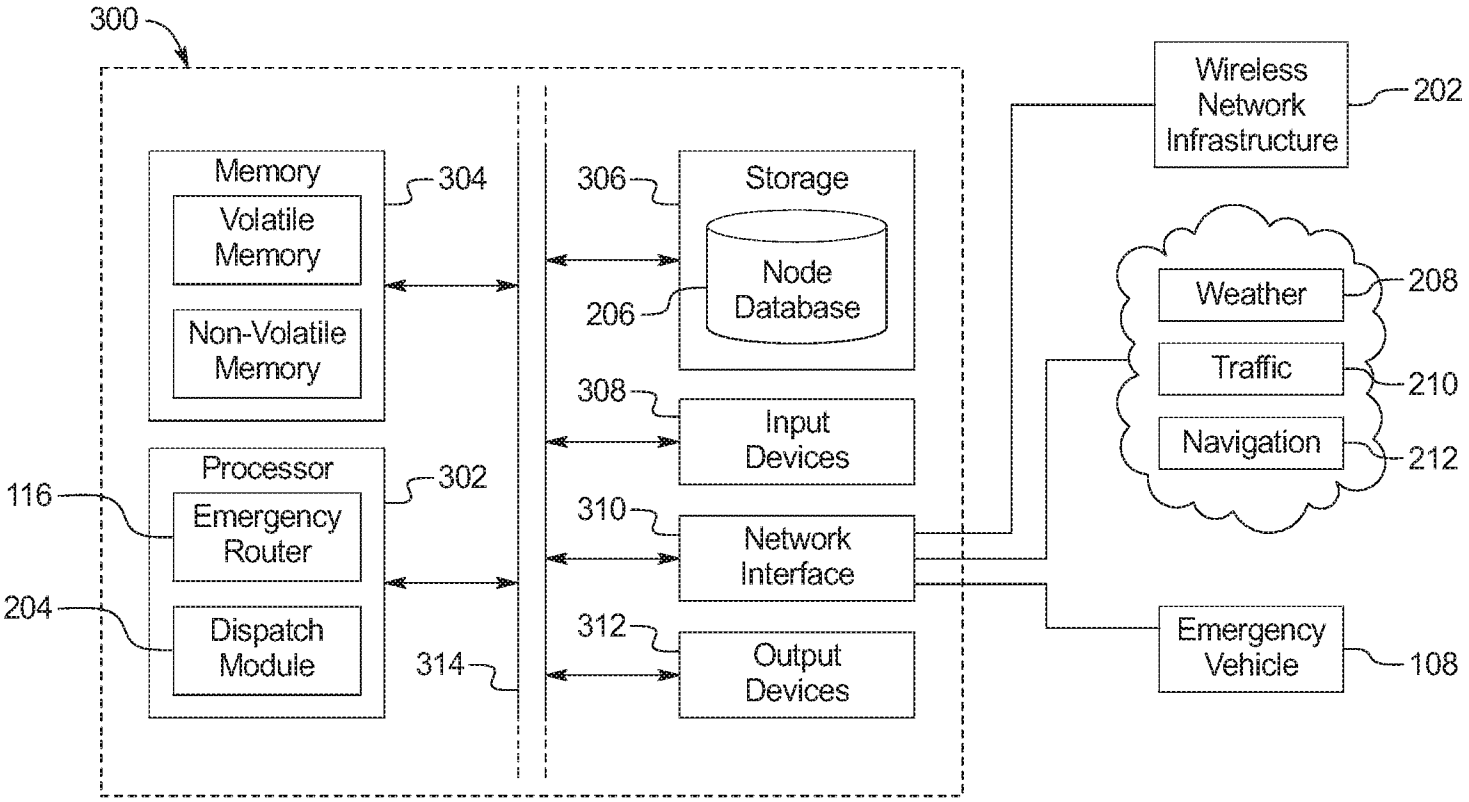
FIG. 3 is a block diagram of electronic components of the emergency dispatch server of FIGS. 1 and 2.

FIG. 3 is a block diagram of electronic components 300 of the emergency dispatch server 104 of FIGS. 1 and 2. In the illustrated example, the electronic components 300 include a processor or controller 302, memory 304, storage 306, a network interface 308, input devices 310, output devices 312, and a data bus 314.

The processor or controller 302 may be any suitable processing device or set of processing devices such as, but not limited to: a microprocessor, a microcontroller-based platform, a suitable integrated circuit, or one or more application-specific integrated circuits (ASICs). In the illustrated example, the processor or controller 302 is structured to include the dispatch module 204 and the emergency router 116. The memory 304 may be volatile memory (e.g., RAM, which can include non-volatile RAM, magnetic RAM, ferroelectric RAM, and any other suitable forms); non-volatile memory (e.g., disk memory, FLASH memory, EPROMs, EEPROMs, memristor-based non-volatile solid-state memory, etc.), unalterable memory (e.g., EPROMs), and read-only memory. In some examples, the memory 304 includes multiple kinds of memory, particularly volatile memory and non-volatile memory. The storage 306 may include any high-capacity storage device, such as a hard drive, and/or a solid state drive. In the illustrated example, the node database 206 is stored in the storage 306.

The memory 304 and the storage 306 are a computer readable medium on which one or more sets of instructions, such as the software for operating the methods of the present disclosure can be embedded. The instructions may embody one or more of the methods or logic as described herein. In a particular embodiment, the instructions may reside completely, or at least partially, within any one or more of the memory 304, the computer readable medium, and/or within the processor 302 during execution of the instructions.

The terms "non-transitory computer-readable medium" and "computer-readable medium" should be understood to include a single medium or multiple media, such as a centralized or distributed database, and/or associated caches and servers that store one or more sets of instructions. The terms "non-transitory computer-readable medium" and "computer-readable medium" also include any tangible medium that is capable of storing, encoding or carrying a set of instructions for execution by a processor, or that cause a system to perform any one or more of the methods or operations disclosed herein. As used herein, the term "computer readable medium" is expressly defined to include any type of computer readable storage device and/or storage disk and to exclude propagating signals.

The network interface 308 facilitates the emergency dispatch server 104 communicating with other network devices. The network interface 308 includes a communication device, such as a modem or a network interface card, to facilitate exchange of data with the wireless network infrastructure 202, the weather server 208, the traffic server 210, the navigation server 212, and/or the emergency vehicle 108 (e.g., an Ethernet connection, a digital subscriber line (DSL), a telephone line, coaxial cable, a cellular telephone system, etc.).

The input device(s) 310 facilitate a user interacting with the electronic components 300. The input device(s) 310 can be implemented by, for example, a serial port, a Universal Serial Bus (USB) port, a IEEE 1339 port, a keyboard, a button, a mouse, a touchscreen, a track-pad, and/or a voice recognition system. The output device(s) 312 facilitate the electronic components 300 providing information to the user. The output devices 312 can be implemented, for example, by display devices (e.g., a light emitting diode (LED), an organic light emitting diode (OLED), a liquid crystal display, a cathode ray tube display (CRT), a touchscreen, etc.), and/or communication devices (the serial port, the USB port, the IEEE 1339 port, etc.).

The data bus 314 communicatively couples the processor 302, the memory 304, the storage 306, the network interface 308, the input devices 310, and the output devices 312. The data bus 314 may be implemented by one or more interface standards, such as an Ethernet interface, a USB interface, PCI express interface, and/or a Serial ATA interface, etc.

Figure 4:
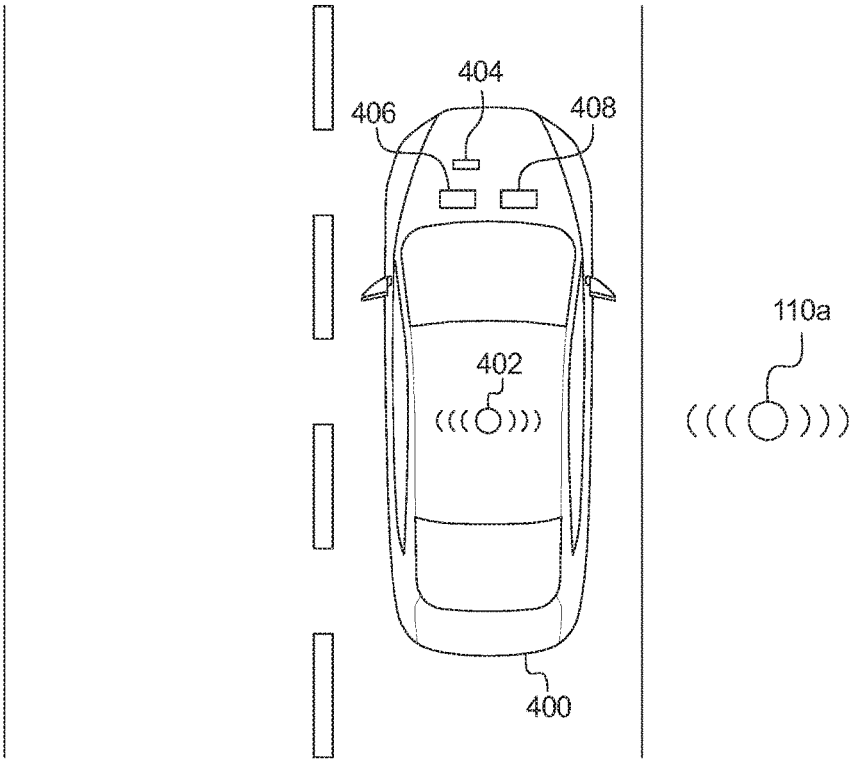
FIG. 4 depicts a vehicle in communication with one of the infrastructure nodes of FIG. 1.

FIG. 4 depicts a vehicle 400 in communication with one of the infrastructure nodes 110*a* of FIG. 1. In the illustrated example, the vehicle 400 includes a DSRC module 402, a GPS receiver 404, a dashboard display 406, emergency alert controller 408. The DSRC module 402 includes antenna(s), radio(s) and software to receive and rebroadcast the emergency corridor messages broadcast by the infrastructure nodes 110*a*. The GPS receiver 404 provides the coordinates of the vehicle 400.

Figure 5:
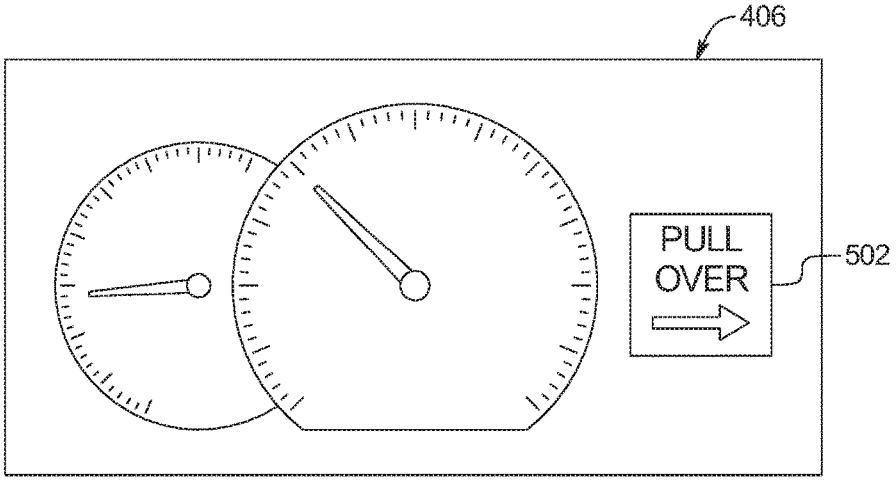
FIG. 5 illustrates a dashboard display of the vehicle of FIG. 4.

As illustrated in FIG. 5, the dashboard display 406 displays information regarding the operation of the vehicle 400, such as a speedometer, an odometer, a tachometer, a fuel gauge, various indicators (e.g., engine temperature, gear shift position, engine check light, etc.). The dashboard display 406 includes analog and/or digital displays. For example, the speedometer and the tachometer may be analog and the odometer, the fuel gauge, and various indicators may be displayed on a digital screen 502. The example digital screen 502 may be a liquid crystal display (LCD), a thin film transistor LCD, an organic light emitting diode (OLED) display, or an active-matrix OLED (AMOLED), etc.

Returning to FIG. 4, the emergency alert controller 408 receives, via the DSRC module 402, the emergency corridor messages broadcast by the infrastructure nodes 110*a* and/or another vehicle. The emergency alert controller 408 whether the current trajectory of the vehicle 400 will run parallel or intersect the route of the emergency corridor 102 identified in the emergency corridor message. If it will, the emergency alert controller 408 activates a visual and/or an audible warning to the occupants of the vehicle 400. In some examples, the emergency alert controller 408 displays instructions in the emergency corridor message on the digital screen 502 of the dashboard display 406. For example, the emergency alert controller 408 may display the words "PULL OVER" along with an arrow pointing to the right. Alternatively or additionally, in some examples, the emergency alert controller 408 may cause a buzzer to sound and/or provide voice instructions. For examples, the emergency alert controller 408 may cause a sound system to say, "Emergency vehicle inbound, please pull over to the right."

In some examples, the emergency alert controller 408 monitors (e.g., via a steering control unit) the actions of the vehicle 400 after the alert is provided. In some such examples, if the vehicle 400 does not respond to the alert, the emergency alert controller 408 repeats the alert and/or disables functions of the infotainment system (e.g., the radio, the hands-free system, etc.) until the vehicle responds to the alert. For example, the emergency alert controller 408 may monitor the steering control unit to determine whether the vehicle 400 has moved to the right. As another example, the emergency alert controller 408 may monitor the speed of the vehicle 400 to determine whether the vehicle has stopped. In some examples, the vehicle 400 includes an adaptive cruise control. In such examples, when the adaptive cruise control is activated, the adaptive cruise control follows the instructions included in the emergency corridor message. For example, the adaptive cruise control may pull the vehicle 400 over to the right side of the road and stop.

Based on the current location of the emergency vehicle 108 included in the emergency corridor message, the emergency alert controller 408 ceases the alert(s) after the current location of the emergency vehicle 108 is passed the location of the vehicle 400 on the route of the emergency corridor 102. In some examples, the emergency alert controller 408 rebroadcasts the emergency corridor message until the current location of the emergency vehicle 108 is passed the location of the vehicle 400.

Figure 6:
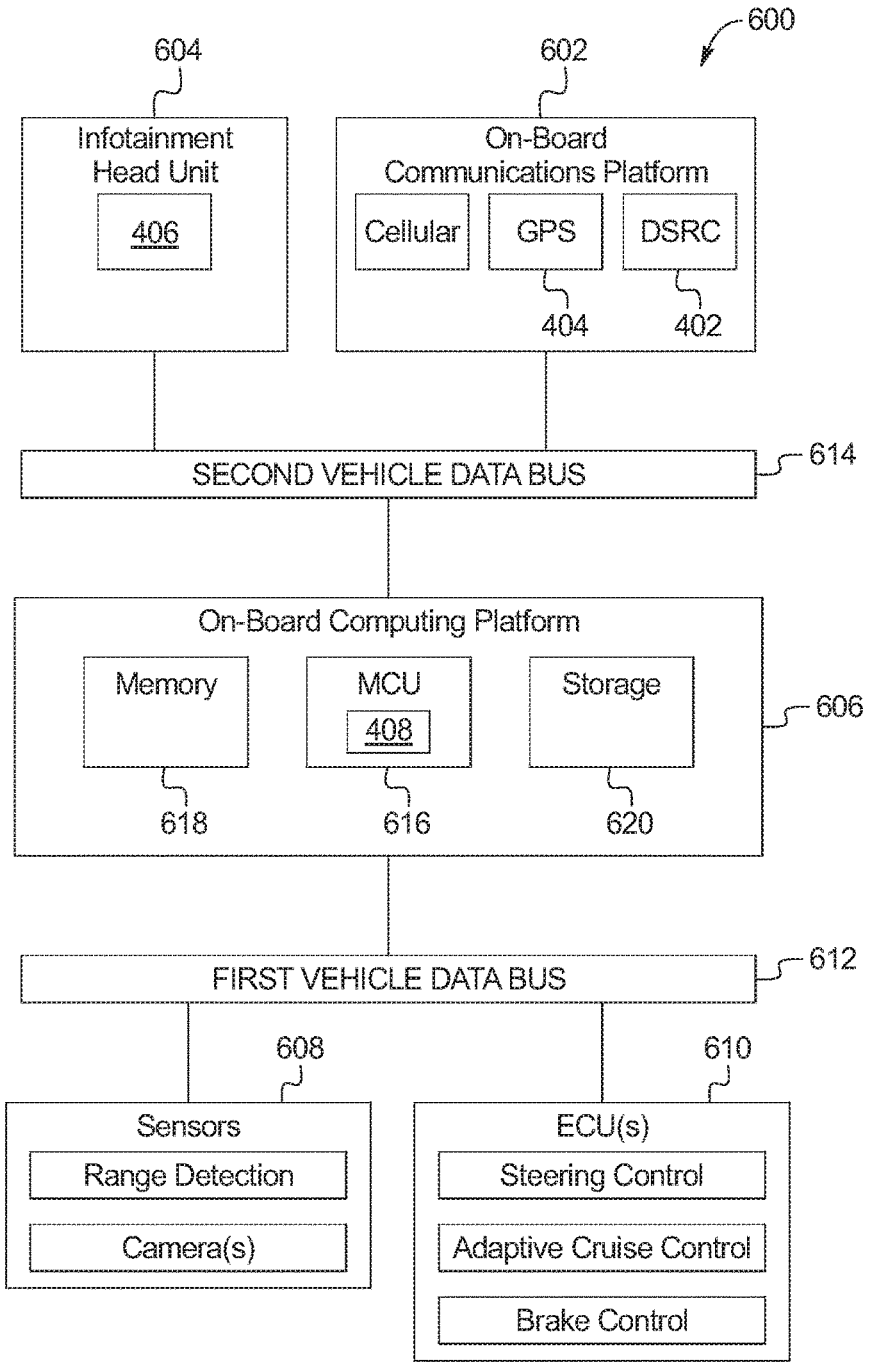
FIG. 6 is a block diagram of electronic components of the vehicle of FIG. 4.

FIG. 6 is a block diagram of electronic components 600 of the vehicle 400 of FIG. 4. The electronic components 600 include an example on-board communications platform 602, the example infotainment head unit 604, an on-board computing platform 606, example sensors 608, example electronic control units (ECUs) 610, a first vehicle data bus 612, and second vehicle data bus 614.

The on-board communications platform 602 includes wired or wireless network interfaces to enable communication with external networks. The on-board communications platform 602 also includes hardware (e.g., processors, memory, storage, antenna, etc.) and software to control the wired or wireless network interfaces. In the illustrated example, the on-board communications platform 602 includes the DSRC module 402 and the GPS receiver 404. In some examples, the on-board communications platform 602 may include a cellular modem that incorporates controllers for standards-based networks (e.g., Global System for Mobile Communications (GSM), Universal Mobile Telecommunications System (UMTS), Long Term Evolution (LTE), Code Division Multiple Access (CDMA), WiMAX (IEEE 802.16m); and Wireless Gigabit (IEEE 802.11ad), etc.). The on-board communications platform 602 may also include one or more controllers for wireless local area networks such as a Wi-FI® controller (including IEEE 802.11 a/b/g/n/ac or others), a Bluetooth® controller (based on the Bluetooth® Core Specification maintained by the Bluetooth Special Interest Group), and/or a ZigBee® controller (IEEE 802.15.4), and/or a Near Field Communication (NFC) controller, etc. Additionally, the on-board communications platform 602 may also include a wired interface (e.g. an auxiliary port, etc.) to enable direct communication with an electronic device (such as, a smart phone, a tablet computer, a laptop, etc.).

The infotainment head unit 604 provides an interface between the vehicle 400 and a user (e.g., a driver, a passenger, etc.). The infotainment head unit 604 includes digital and/or analog interfaces (e.g., input devices and output devices) to receive input from the user(s) and display information. The input devices may include, for example, a control knob, an instrument panel, a digital camera for image capture and/or visual command recognition, a touch screen, an audio input device (e.g., cabin microphone), buttons, or a touchpad. The output devices may include instrument cluster outputs (e.g., dials, lighting devices), actuators, a heads-up display, a center console display (e.g., a liquid crystal display ("LCD"), an organic light emitting diode ("OLED") display, a flat panel display, a solid state display, etc.), and/or speakers. In the illustrated example, the infotainment head unit 604 includes the dashboard display of FIGS. 4 and 5.

The on-board computing platform 606 includes a processor or controller 616, memory 618, and storage 620. In some examples, the on-board computing platform 606 is structured to include the emergency alert controller 408. The processor or controller 616 may be any suitable processing device or set of processing devices such as, but not limited to: a microprocessor, a microcontroller-based platform, a suitable integrated circuit, one or more FPGAs, and/or one or more ASICs. The memory 618 may be volatile memory (e.g., RAM, which can include non-volatile RAM, magnetic RAM, ferroelectric RAM, and any other suitable forms); non-volatile memory (e.g., disk memory, FLASH memory, EPROMs, EEPROMs, memristor-based non-volatile solid-state memory, etc.), unalterable memory (e.g., EPROMs), and read-only memory. In some examples, the memory 618 includes multiple kinds of memory, particularly volatile memory and non-volatile memory. The storage 620 may include any high-capacity storage device, such as a hard drive, and/or a solid state drive.

The memory 618 and the storage 620 are a computer readable medium on which one or more sets of instructions, such as the software for operating the methods of the present disclosure can be embedded. The instructions may embody one or more of the methods or logic as described herein. In a particular embodiment, the instructions may reside completely, or at least partially, within any one or more of the memory 618, the computer readable medium, and/or within the processor 616 during execution of the instructions.

The sensors 608 may be arranged in and around the vehicle 400 in any suitable fashion. In the illustrated example, the sensors 608 include range detection sensors and camera(s). The ECUs 610 monitor and control the systems of the vehicle 400. The ECUs 610 communicate and exchange information via the first vehicle data bus 612. Additionally, the ECUs 610 may communicate properties (such as, status of the ECU 610, sensor readings, control state, error and diagnostic codes, etc.) to and/or receive requests from other ECUs 610. Some vehicles 400 may have seventy or more ECUs 610 located in various locations around the vehicle 400 communicatively coupled by the first vehicle data bus 612. The ECUs 610 are discrete sets of electronics that include their own circuit(s) (such as integrated circuits, microprocessors, memory, storage, etc.) and firmware, sensors, actuators, and/or mounting hardware. In the illustrated example, the ECUs 610 include the steering control unit, the brake control unit, and the adaptive cruise control unit.

The first vehicle data bus 612 communicatively couples the sensors 608, the ECUs 610, the on-board computing platform 606, and other devices connected to the first vehicle data bus 612. In some examples, the first vehicle data bus 612 is implemented in accordance with the controller area network (CAN) bus protocol as defined by International Standards Organization (ISO) 11898-1. Alternatively, in some examples, the first vehicle data bus 612 may be a Media Oriented Systems Transport (MOST) bus, or a CAN flexible data (CAN-FD) bus (ISO 11898-7). The second vehicle data bus 614 communicatively couples the on-board communications platform 602 the infotainment head unit 604, and the on-board computing platform 606. The second vehicle data bus 614 may be a MOST bus, a CAN-FD bus, or an Ethernet bus. In some examples, the on-board computing platform 606 communicatively isolates the first vehicle data bus 612 and the second vehicle data bus 614 (e.g., via firewalls, message brokers, etc.). Alternatively, in some examples, the first vehicle data bus 612 and the second vehicle data bus 614 are the same data bus.

Figure 7:
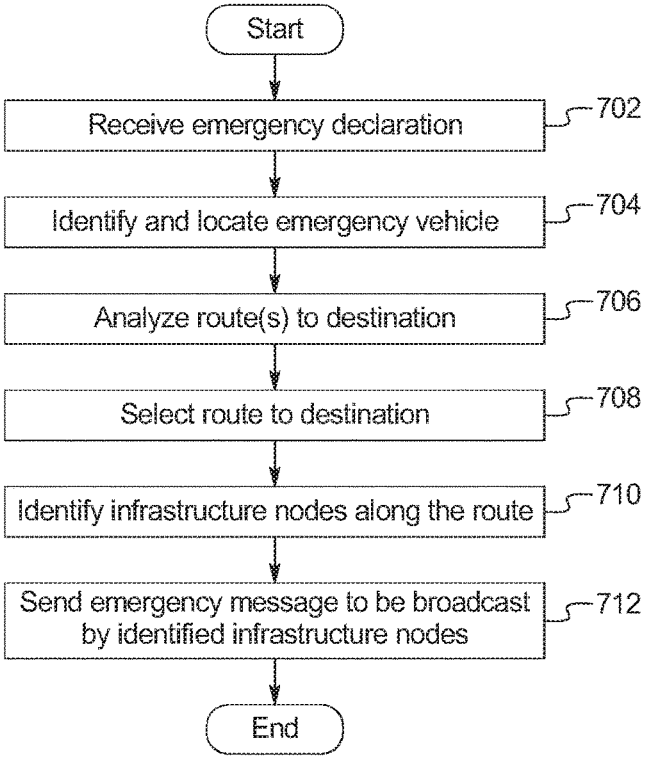
FIG. 7 is a flowchart of an example method to create the emergency corridor of FIG. 1.

FIG. 7 is a flowchart of an example method to create the emergency corridor 102 of FIG. 1. Initially, at block 702, the dispatch module 204 receives an emergency declaration. For example, the dispatch module 204 may receive an emergency declaration containing a location (e.g., the location 106 of FIG. 1) from a fire alarm system. At block 704, the emergency router 116 identifies and locates the emergency vehicle(s) 108 within a radius of the location 106. At block 706, the emergency router 116 analyzes the route(s) between the emergency vehicle(s) 108 and the location 106. At block 708, the emergency router 116 selects the route to the location 106 to become the emergency corridor 102. In some examples, the emergency router 116 also selects one of the emergency vehicles 108 identified at block 704 to respond to the emergency declaration received at block 702. At block 710, the emergency router 116 identifies the infrastructure nodes 110*a* along the route selected at block 708. At block 712, the emergency router 116 instructs the infrastructure nodes 110*a* identified at block 710 to broadcast an emergency corridor message including the current location of the emergency vehicle 108, the velocity of the emergency vehicle 108, the route of the emergency corridor 102, and instructions (e.g., which lane to clear, etc.). The method of FIG. 7 then ends.

Figure 8:
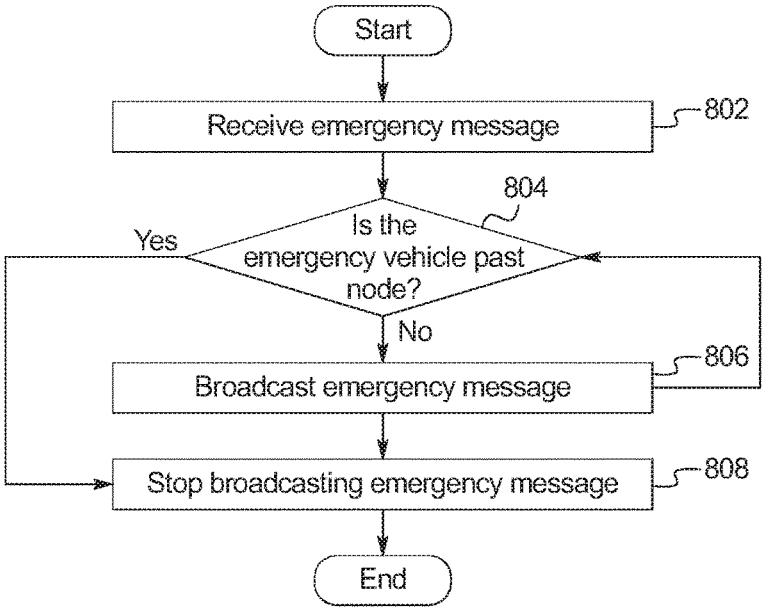
FIG. 8 is a flowchart of an example method to broadcast emergency messages by infrastructure nodes along the emergency corridor.

FIG. 8 is a flowchart of an example method to broadcast emergency messages by infrastructure nodes 110*a* along the route of the emergency corridor 102. Initially, at block 802, the infrastructure node 110*a* receives the instruction to broadcast the emergency corridor message from the emergency dispatch server 104. At block 804, the infrastructure node 110*a* determines whether the emergency vehicle 108 has passed the infrastructure nodes 110*a* based on the location of the infrastructure node 110*a*, the current location of the emergency vehicle 108 included in the instructions to broadcast the emergency corridor message, and the route of the emergency corridor 102 included in the instructions to broadcast the emergency corridor message. If the infrastructure node 110*a* determines the emergency vehicle 108 has not passed the infrastructure node 110*a*, at block 806, the infrastructure node 110*a* broadcasts the emergency corridor message. Otherwise, if the infrastructure node 110*a* determines the emergency vehicle 108 has passed the infrastructure node 110*a*, at block 806, the infrastructure node 110*a* ends broadcasting the emergency corridor message. The method of FIG. 8 then ends.

Figure 9:
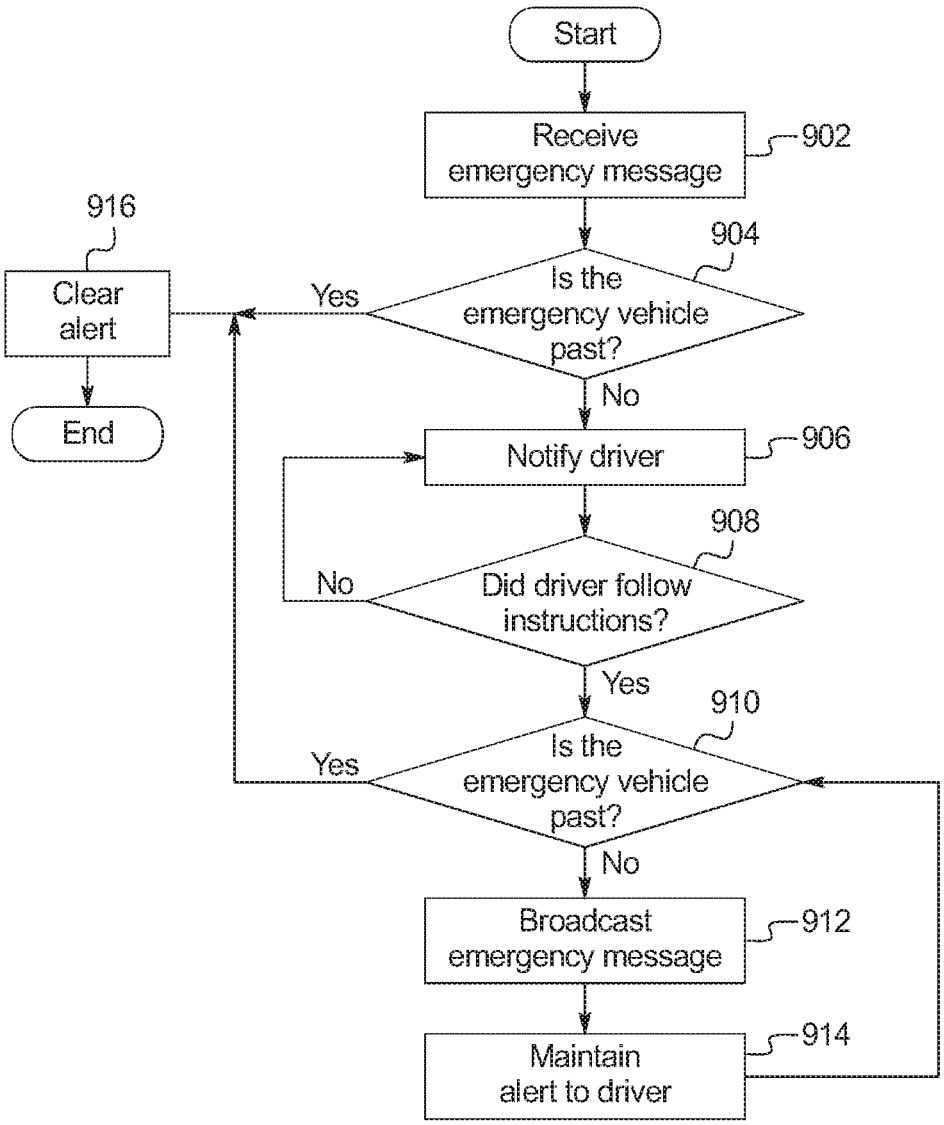
FIG. 9 is a flowchart of an example method for the vehicles to react to the emergency messages broadcast by the infrastructure nodes along the emergency corridor.

FIG. 9 is a flowchart of an example method for the vehicles 400 of FIG. 4 to react to the emergency messages broadcast by the infrastructure nodes 110*a* along the route of the emergency corridor 102. Initially, at block 902, the emergency alert controller 408 of the vehicle 400 receives the emergency corridor message. At block 904, the emergency alert controller 408 determines whether the emergency vehicle 108 has passed the vehicle 400 based on the location of the vehicle 400, the current location of the emergency vehicle 108 included in the emergency corridor message, and the route of the emergency corridor 102 included in the emergency corridor message. If the emergency vehicle 108 has passed the vehicle 400, the method continues at block 916. Otherwise, if the emergency vehicle 108 has not passed the vehicle 400, the method continues at block 906.

At block 906, the emergency alert controller 408 notifies the occupants of the vehicle 400 of the emergency corridor 102. The emergency alert controller 408 provides a visual and/or audible alert via the dashboard display 406 and/or the speakers of infotainment head unit 604 based on instructions in the emergency corridor message. At block 908, the emergency alert controller 408 determines whether the driver followed the instructions. For example, the emergency alert controller 408 may analyze the output of the steering control unit to determine whether the vehicle 400 moved to the right, or analyze the output of the brake control unit to determine whether the vehicle stopped. If the driver did not follow the instructions, the method returns to block 906, at which the emergency alert controller 408 notifies the driver. In some examples, the emergency alert controller 408 escalates the lever of notification. If the driver followed the instructions, the method continues to block 910.

At block 910, the emergency alert controller 408 determines whether the emergency vehicle 108 has passed the vehicle 400 based on the location of the vehicle 400, the current location of the emergency vehicle 108 included in the emergency corridor message, and the route of the emergency corridor 102 included in the emergency corridor message. If the emergency vehicle 108 has passed the vehicle 400, the method continues at block 916. Otherwise, if the emergency vehicle 108 has not passed the vehicle 400, the method continues at block 912. At block 912, the emergency alert controller 408 rebroadcasts the emergency message. At block 914, the emergency alert controller 408 continues to notify the driver. In some examples, the notification may change to, for example, just a visual notification on the dashboard display 406. At block 916, the emergency alert controller 408 clears the notification(s) of the emergency corridor message and/or discontinues broadcasting the emergency notification message.

The flowchart of FIG. 7 is a method that may be implemented by machine readable instructions that comprise one or more programs that, when executed by a processor (such as the processor 302 of FIG. 3), cause the emergency dispatch server 104 to implement the emergency router 116 of FIGS. 1, 2, and 3. The flowchart of FIG. 8 is a method that may be implemented by machine readable instructions that comprise one or more programs that, when executed by a processor, implement the infrastructure nodes 110*a* and 110*b* of FIG. 1. The flowchart of FIG. 9 is a method that may be implemented by machine readable instructions that comprise one or more programs that, when executed by a processor (such as the processor 616 of FIG. 5), cause the vehicle 400 to implement the emergency alert controller 408 of FIGS. 4 and 6. Further, although the example program(s) is/are described with reference to the flowcharts illustrated in FIGS. 7, 8, and 9, many other methods of implementing the example emergency router 116, infrastructure nodes 110*a* and 110*b*, and/or emergency alert controller 408 may alternatively be used. For example, the order of execution of the blocks may be changed, and/or some of the blocks described may be changed, eliminated, or combined.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or." The terms "includes," "including," and "include" are inclusive and have the same scope as "comprises," "comprising," and "comprise" respectively.

The above-described embodiments, and particularly any "preferred" embodiments, are possible examples of implementations and merely set forth for a clear understanding of the principles of the invention. Many variations and modifications may be made to the above-described embodiment(s) without substantially departing from the spirit and principles of the techniques described herein. All modifications are intended to be included herein within the scope of this disclosure and protected by the following claims.

What is claimed is:

1. An emergency response system comprising:

an emergency vehicle;

infrastructure nodes distributed across a municipal area; and an emergency router to:

select a route from a first location of the emergency vehicle to a second location specified by an emergency request;

select the infrastructure nodes that are along the route; and instruct the selected infrastructure nodes to broadcast emergency messages, the emergency messages including information regarding the emergency vehicle, the selected infrastructure nodes individually determining when to stop broadcasting the emergency messages based on third locations of the selected infrastructure nodes and a current location of the emergency vehicle identified in the emergency messages.

2. The system of claim 1, wherein the emergency messages include the route of the emergency vehicle, the current location of the emergency vehicle, a current heading of the emergency vehicle, and a current speed of the emergency vehicle.

3. The system of claim 1, wherein the emergency router is to:

instruct the emergency vehicle to traverse the route; and update the emergency messages to include a current location, a current heading, and a current speed of the emergency vehicle.

4. The system of claim 1, wherein the emergency vehicle is to broadcast the emergency messages.

5. A method comprising:

receiving, by a DSRC module of a vehicle, an emergency message including a route, a current location, a current heading, and a current speed of an emergency vehicle;

determining, with a processor, whether a trajectory of the vehicle will be parallel or intersect the route;

in response to determining that the trajectory of the vehicle will be parallel or intersect the route, providing, via an infotainment head unit, an audio and visual warning based on instructions included in the emergency message;

monitoring the vehicle to determine whether properties of the vehicle changed after the audio and visual warning; and in response to determining that the properties of the vehicle did not change after the audio and visual warning, increasing a frequency of the audio and visual warning provided by the infotainment head unit.

6. The method of claim 5, wherein the properties of the vehicle include a speed of the vehicle and a lane in which the vehicle is traveling.

7. The method of claim 5, including determining whether the emergency vehicle has passed the vehicle based on a current position of the vehicle and the current position of the emergency vehicle in the emergency message.

8. The method of claim 7, including in response to determine that the emergency vehicle has not passed the vehicle, broadcasting, by DSRC module of the vehicle, the emergency message.

9. The method of claim 7, including in response to determine that the emergency vehicle has passed the vehicle, ending the audio and visual warning.

10. A method comprising:

selecting, with a processor, infrastructure nodes distributed across a municipal area positioned along a route defined by a first location of an emergency vehicle and a second location specified by an emergency request;

broadcasting emergency messages via the selected infrastructure nodes; and determining, individually by the selected infrastructure nodes, when to stop broadcasting the emergency messages based on third locations of the infrastructure nodes and a current location of the emergency vehicle.

11. The method of claim 10, wherein the emergency messages include a current location of the emergency vehicle, a current heading of the emergency vehicle, and a current speed of the emergency vehicle.

12. The method of claim 10, including:

instruct the emergency vehicle to traverse the route; and update the emergency messages to include a current location, a current heading, and a current speed of the emergency vehicle.

13. The method of claim 10, including broadcasting the emergency messages via the emergency vehicle.

14. The method of claim 10, including:

determining that the emergency vehicle has not passed a vehicle traversing the route based on a third location of the vehicle and a current location of the emergency vehicle; and broadcasting the emergency message via the vehicle while the emergency vehicle has not passed the vehicle.

* * * * *